United States Patent [19]

Stäbler

[11] Patent Number: 4,815,205

[45] Date of Patent: Mar. 28, 1989

[54] APPARATUS FOR MOUNTING METAL BEGINNING PIECES ON A CONTINUOUS SLIDE FASTENER CHAIN

[75] Inventor: Gerhard Stäbler, Filderstadt, Fed. Rep. of Germany

[73] Assignee: Opti Patent-, Forschungsund Fabrikations-AG, Riedern-Allmeind, Switzerland

[21] Appl. No.: 179,594

[22] Filed: Apr. 11, 1988

[30] Foreign Application Priority Data

Apr. 11, 1987 [DE] Fed. Rep. of Germany ..... 3712402

[51] Int. Cl.[4] ..... A41H 37/06

[52] U.S. Cl. ..... 29/767; 29/408; 29/33.2

[58] Field of Search ..... 29/766, 767, 408, 33.2

[56] References Cited

U.S. PATENT DOCUMENTS

| | | | |
|---|---|---|---|
| 3,588,991 | 6/1971 | Maisenbacher | 29/767 |
| 3,689,980 | 9/1972 | Oyama | 29/767 |
| 4,332,071 | 6/1982 | Takahahi | 29/767 |
| 4,433,478 | 2/1984 | Oyama | 29/767 |
| 4,704,781 | 11/1987 | Fröhlich | 29/33.2 |
| 4,711,020 | 12/1987 | Watanabe et al. | 29/767 |

*Primary Examiner*—P. W. Echols
*Attorney, Agent, or Firm*—Herbert Dubno

[57] ABSTRACT

The apparatus puts at least one metal beginning piece on a cotinuous slide fastener chain made by connecting a plurality of slide fasteners each with beginning piece regions prepared for receiving a metal beginning piece and with the first slide fastener coupling members bounding the beginning piece regions of the slide fasteners. The opened slide fastener chain is moveable or advanceable stepwise by the apparatus. The apparatus comprises a tool block which is slidable on a plurality of guide rods oriented substantially in the feed direction of the slide fastener chain, two contacting elements associated with both halves of the open slide fastener chain mounted on the tool block which are pivotable about contacting element pivot axes substantially parallel to the guide rods, two clamp jaws associated with the contacting elements mounted on the tool block which similarly pivot about clamp jaw pivot axes substantially parallel to the guide rods, a control member for operation of the clamp jaws which has at least one control surface extending substantially in the longitudinal direction of the guide rods which engages at least one opposing control surface on the clamp jaws and a beginning piece mounting tool.

6 Claims, 3 Drawing Sheets

3
4
5
6
7
2
2'
2''
2'''
f
19
19s
19m
19c
19'
II
10
11

APPARATUS FOR MOUNTING METAL BEGINNING PIECES ON A CONTINUOUS SLIDE FASTENER CHAIN

FIELD OF THE INVENTION

My present invention relates to an apparatus for manufacturing or assembling a slide fastener and, more particularly, to an apparatus for putting metal beginning pieces on a continuous slide fastener chain.

BACKGROUND OF THE INVENTION

Metal beginning pieces can be mounted on a continuous slide fastener chain having two stringer halves with interdigitated or coupled rows of coupling heads by spreading the coupling elements and fixing the beginning pieces in place. Each with a beginning piece region can thus receive a metal beginning piece and can be bounded by the first slide fastener coupling members of the slide fasteners. This apparatus is part of a machine for manufacturing or assembling slide fasteners. The open slide fastener chain is advanced stepwise by the apparatus.

The slide fastener coupling members can be part of a continuous row of slide fastener coupling members made from a thermoplastic monofilament or can be a plurality of individual slide fastener coupling members made from metal or plastic. The opening of the slide fastener chain is effected for the purpose of mounting the beginning pieces by a spreading finger or similar element.

The known apparatus for mounting or putting on beginning pieces on a slide fastener chain is known to involve considerable effort and expense in regard to kinematics and consequently control engineering. Also its operational reliability needs improvement. That is because the slide fastener chain must be positioned very exactly with the beginning piece regions positionable under the beginning piece setting tool which is moveable up and down. It must be detected and oriented with precision. Up to now the slide fastener chain takes only a passive part in the mounting of the metallic beginning pieces.

OBJECTS OF THE INVENTION

It is an object of my invention to provide an apparatus for mounting a metallic beginning piece on a continuous slide fastener chain which does not have the above mentioned disadvantages and difficulties.

It is also an object of my invention to provide an apparatus for putting a metallic beginning piece on a continuous slide fastener chain which is characterized by simplified kinematics and control engineering.

It is another object of my invention to provide an apparatus for putting a metallic beginning piece on a continuous slide fastener chain which is characterized by a high reliability.

SUMMARY OF THE INVENTION

These objects and others which will become more readily apparent hereinafter are attained in accordance with my invention in an apparatus for putting at least one metal beginning piece on a continuous slide fastener chain formed of a pair of interconnected stringer halves each prepared with a beginning piece region for mounting of the metal beginning piece and with the first slide fastener coupling members bounding the beginning piece regions of the slide fasteners. The opened slide fastener chain is moveable or advanceable stepwise by the apparatus.

According to my invention the apparatus comprises:

- a tool block which is slidable on a plurality of guide rods oriented substantially in the feed direction of the slide fastener chain,
- two contacting elements associated with both halves of the open slide fastener chain mounted on the tool block which are pivotable about contacting element pivot axes substantially parallel to the guide rods,
- two clamp jaws associated with the contacting elements mounted on the tool block which similarly pivot about clamp jaw pivot axes substantially parallel to the guide rods,
- a control member for operation of the clamp jaws which has at least one control surface extending substantially in the longitudinal direction of the guide rods which engages at least one opposing control surface on the clamp jaws and
- a beginning piece mounting tool.

The tool block is moveable with the slide fastener chain on the guide rods from a receiving position to a beginning piece mounting location by the slide fastener chain when the first slide fastener coupling members contact the contacting elements.

Then the clamp jaws are closable by the control surface against the contacting elements with the transported stringer halves of the open slide fastener chain interposed during motion of the tool block with the slide fastener chain. Then the beginning pieces are mountable in the beginning piece mounting location in the beginning piece mounting region on the transported stringer halves of the open slide fastener chain by a beginning piece mounting tool moveable up and down and the contacting elements are forced away from the beginning piece mounting tool during the mounting motion perpendicular to the guide rods.

The slide fastener chain advanced stepwise according to my invention is no longer only a passive element on which the process steps and or manufacturing steps are performed. It additionally fulfills the function of an adjusting element for the tool block with its components and moves this tool block from the contacting position to the beginning piece mounting location.

The positioning of the first slide fastener members and thus the beginning pieces relative to the contacting elements and after that of the contacting elements relative to the beginning piece mounting tool moved up and down is effected automatically.

Special adjusting drives for positioning or an expensive feed of the slide fastener in the apparatus for putting on the metal beginning pieces are consequently not required. From this motion which the slide fastener chain performs additional motions are derived as described below.

In regard to the detailed structure and function of my invention there are various possibilities. In one advantageous embodiment of my invention characterized by simplicity the guide rods are oriented substantially in the feed direction of the slide fastener chain according to a climbing inclined plane and the tool block when free is returnable to the contacting position from the beginning piece mounting location by the force of gravity. Of course here the force of gravity is used for the return of the tool block which would have otherwise travelled with the slide fastener chain.

It is also possible however to design the apparatus so that the guide rods are horizontally positioned and the free tool block is returnable under the influence of a returning spring from the beginning piece mounting location to the contacting position. Also the contacting elements must be mounted in a suitable way in the tool block so that they have the required degrees of freedom for the motions described already.

Moreover the contacting elements can be mounted on a mounting plate slidable perpendicular to the guide rods. They can have at least one bearing surface and can be pivotable by at least one opposing bearing surface on the tool block during the mounting motion of the beginning piece mounting tool. The beginning piece mounting tool can be part of a mounting machine with which beginning pieces are cross cut and shaped from a metal strip.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
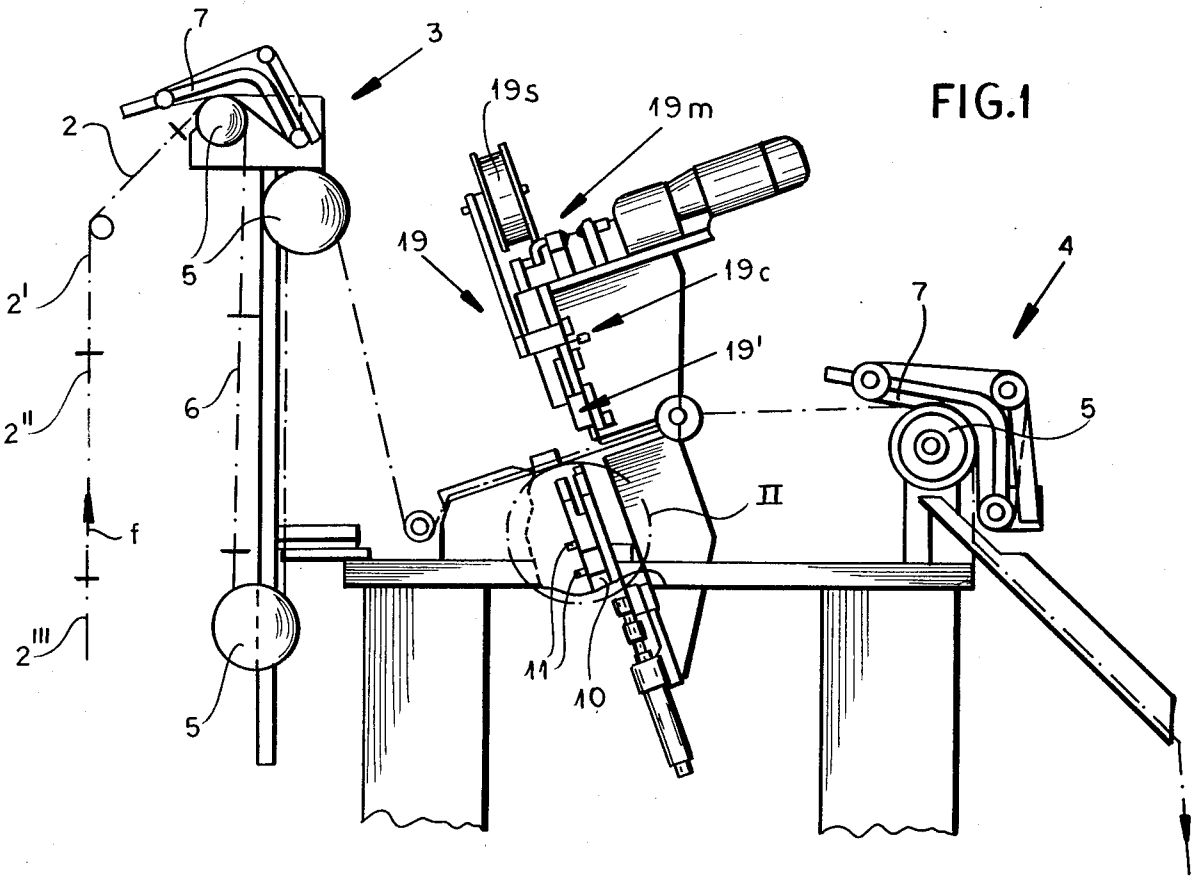
FIG. 1 is a side elevation view of a machine which includes one embodiment of an apparatus for putting on metal beginning piece, on a continuous slide fastener chain according to my invention.

The machine shown in FIG. 1 acts to put on metal beginning pieces 1 on a continuous slide fastener chain 2. This machine has a feed mechanism 3 and a delivery mechanism 4. The feed mechanism 3 has a plurality of rollers 5 which guide the slide fastener chain 2 through a length compensating loop 6. Feeding and delivery occur by a belt drive 7 whose belt clings to and engages one of the feed and/or delivery rollers 5 with a predetermined contact angle. These mechanisms are incorporated in the machine because they allow both a slide fastener chain 2 which is equipped with a sliding piece and also a sliding piece free slide fastener chain 2 to be fed through the device.

In the middle portion of FIG. 1 is located the apparatus for putting on metal beginning pieces 1 on the continuous slide fastener chain 2 made by connecting a plurality of slide fasteners 2', 2'', 2''', etc with beginning piece regions 8 prepared for mounting the beginning piece 1 and with the first slide fastener coupling members 9 bounding the beginning piece region 8. The open slide fastener chain 2 is advanced stepwise through the apparatus.

Figure 4:
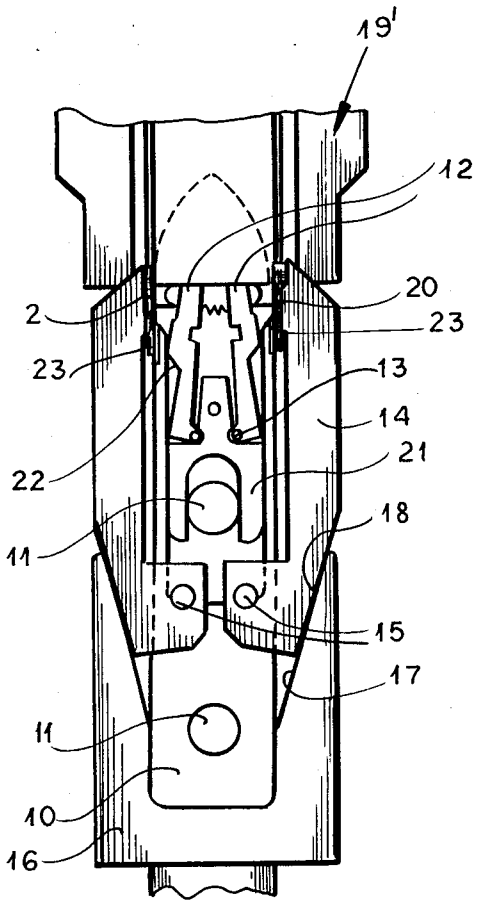
FIG. 4 is a rear view of the device shown in FIG. 2 similar to FIG. 3 but with the device in another working configuration.
Figure 3:
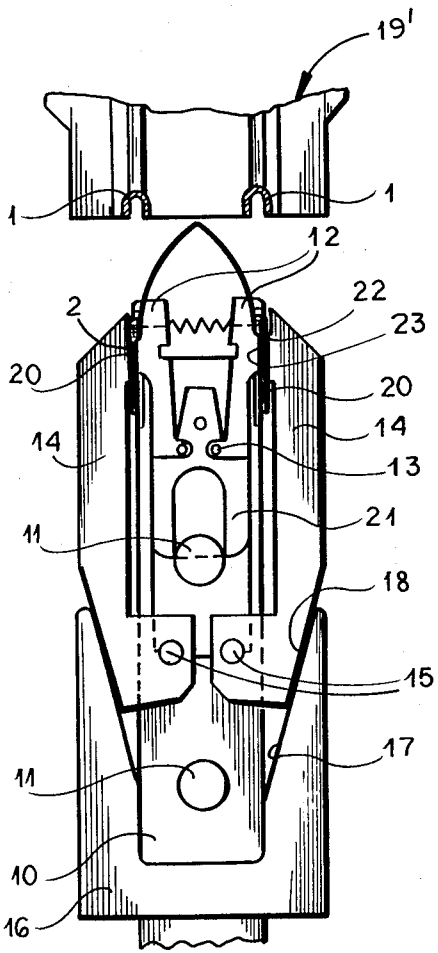
FIG. 3 is a rear view of the device shown in FIG. 2 seen in the direction of the arrow III.
Figure 2:
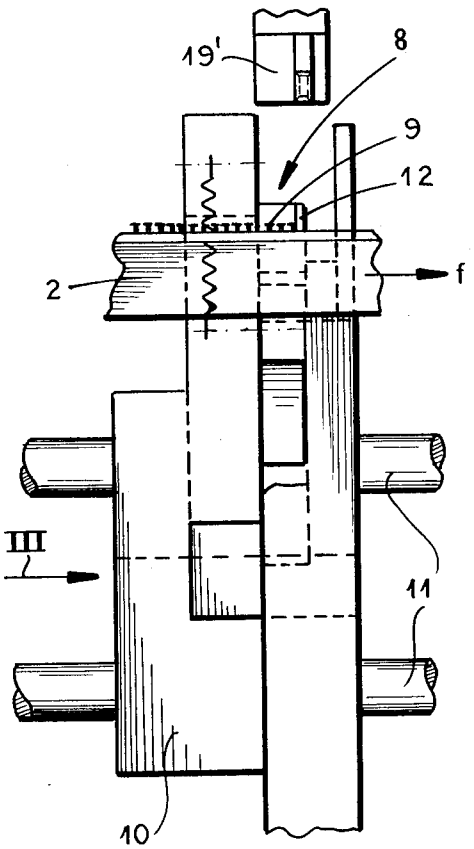
FIG. 2 is a side elevational view, drawn to a larger scale, showing a portion II of the machine shown in FIG. 1.

By and comparison of FIG. 1 with FIGS. 2 to 4 on the other hand it is apparent that the first embodiment of the apparatus according to my invention basically comprises:

a tool block 10 which is slidable on guide rods 11 oriented in the feed direction f of the slide fastener chain 2, and thus provides a carriage, two contacting elements 12 associated with both halves of the open slide fastener chain 2 mounted on the tool block 10 which are pivotable about contacting element pivot axes 13 parallel to the guide rods 11, two clamp jaws 14 associated with the contacting elements 12 mounted on the tool block 10 which similarly pivot about clamp jaw pivot axes 15 parallel to the guide rods 11, a control member 16 for operation of the clamp jaws 14 which has control surfaces 17 extending substantially in the longitudinal direction of the guide rods 11 which engage opposing control surfaces 18 on the clamp jaws 14, and a beginning piece mounting tool 19'.

The tool block 10 slidable on the guide rods 11 is moveable from a receiving position or configuration shown in FIG. 3 to a beginning piece mounting location or configuration shown in FIG. 4. It travels with the travelling slide fastener chain 2 when the slide fastener coupling members 9 contact on the contacting elements 12 as is apparent in FIG. 2.

The clamp jaws 14 can be closed against the contacting elements 12 with the transported stringer halves 20 of the open slide fastener chain 2 interposed by control surfaces 17 during the travelling motion of the tool block 10. This is shown in FIG. 3.

The beginning pieces 1 (in this case two beginning pieces 1) are then mounted or put on the transported stringer halves 20 of the open slide fastener chain 2 with the tool block 10 in the beginning piece mounting location in the beginning piece mounting region 8 by the beginning piece mounting tool 19' moveable up and down at the beginning piece mounting location (FIG. 2).

The contacting elements 12 can be forced away from the beginning piece mounting tool 19' during the mounting motion perpendicular to the axis of the guide rods 11. This is shown in FIG. 4.

In this example and according to one advantageous embodiment of my invention the guide rods 11 are oriented in the feed direction f of the slide fastener chain 2 according to or essentially in an inclined slanting plane. The tool block 10 when free can as a result slide back into the contacting position from the beginning piece mounting location by operation of the force of gravity. One could in another embodiment also provide a returning spring.

From FIGS. 3 and 4 it can be seen that the contacting elements 12 are mounted pivotally on a mounting plate 21 perpendicular to the guide rods 11. They have inclined bearing surfaces 22 and are pivotable by opposing bearing surfaces 23 on the tool block 10 during the mounting motion of the beginning piece mounting tool 19'. The beginning piece mounting tool 19' is part of a mounting machine 19 which could be only indicated in part in FIG. 1. The beginning piece 1 can be cross cut with a cutter **19*c* and molded with a die or press 19*m* from a metal strip 19*s* in this mounting machine 19**.

Figure 5:
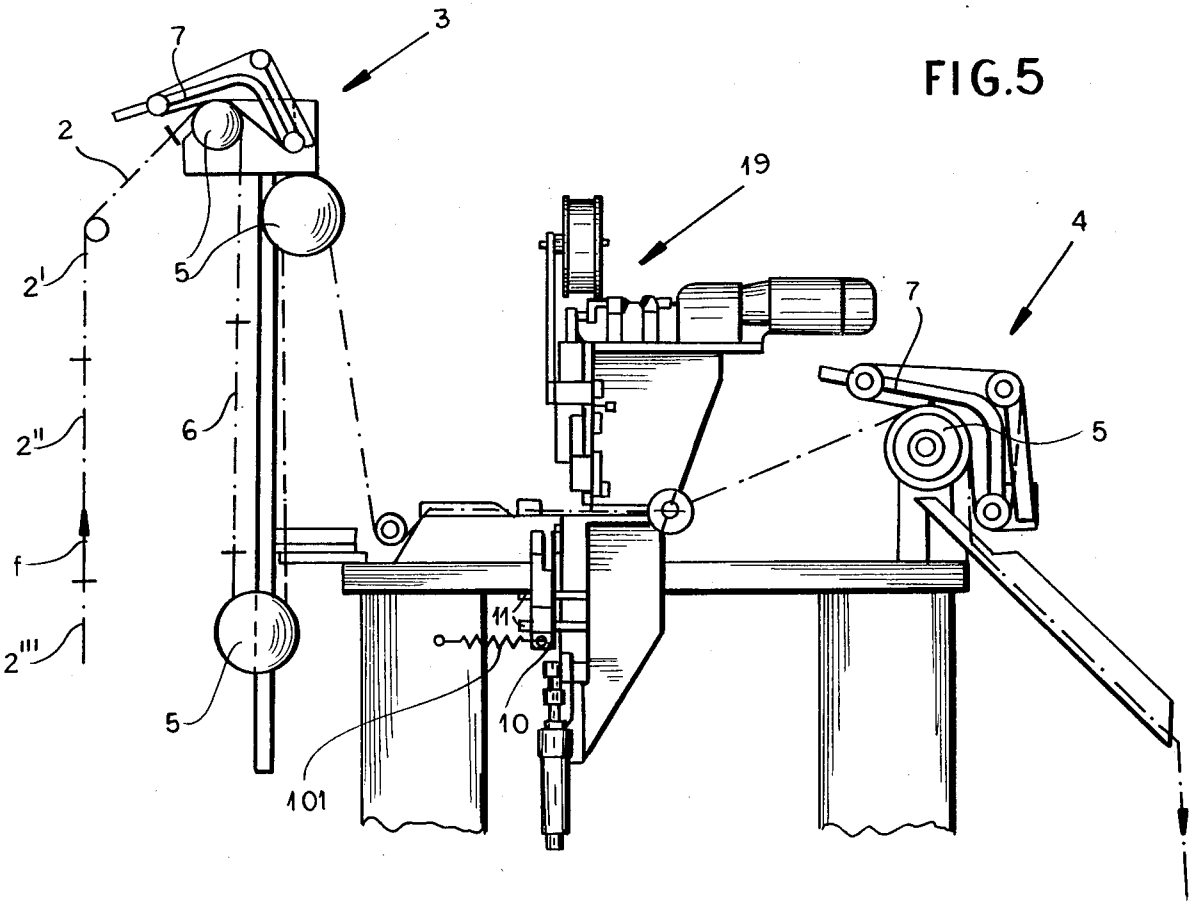
FIG. 5 is a side elevation view of a machine which includes another embodiment of an apparatus for putting on metal beginning pieces on a continuous slide fastener chain according to my invention.

FIG. 5 shows another embodiment of the apparatus for mounting metal beginning pieces on a continuous slide fastener chain according to my invention. This embodiment is the same as the previous embodiment except that the guide rods 11 are oriented substantially horizontal so that the longitudinal axis of the tool block 10 is substantially vertical. In this embodiment a returning spring 101 is used to return the tool block 10 when free to the contacting position from the beginning piece mounting location. Parts that are the same in the embodiment shown in FIG. 5 as in the previous embodiment are indicated with the same reference character.

I claim:

1. In an apparatus for putting at least one metal beginning piece on a continuous slide fastener chain having two interconnected stringer halves each having a beginning piece region for receiving said metal beginning piece and with first slide fastener coupling members bounding said beginning piece region, said slide fastener chain being open and moveable stepwise by said apparatus, the improvement comprising a tool block which is slidable on a plurality of guide rods oriented substantially in the feed direction of said slide fastener chain, two contacting elements associated with both halves of said open slide fastener chain mounted on said tool block which are pivotable about contacting element pivot axes substantially parallel to said guide rods, two clamp jaws associated with said contacting elements mounted on said tool block which similarly pivot about clamp jaw pivot axes substantially parallel to said guide rods, a control member for operation of said clamp jaws which has at least one control surface extending substantially in the longitudinal direction of said guide rods which engages at least one opposing control surface on said clamp jaws, and a beginning piece mounting tool, said tool block being moveable with said slide fastener chain on said guide rods from a receiving position to a beginning piece mounting location by said slide fastener chain when said first slide fastener coupling members contact said contacting elements and said clamp jaws being closable by said control surface against said contacting elements with the transported stringer halves of said slide fastener chain interposed during motion of said tool block with said slide fastener chain, then said beginning pieces being mountable in said beginning piece mounting location in said beginning piece mounting region on said transported stringer halves of said slide fastener chain by said beginning piece mounting tool moveable up and down and said contacting elements being forced away from said beginning piece mounting tool during a mounting motion perpendicular to said guide rods.

2. The improvement defined in claim 1 wherein said guide rods oriented substantially in said feed direction of said slide fastener chain are also essentially in an ascending inclined plane and said tool block when free is returnable by action of the force of gravity from said beginning piece mounting location into a contacting position.

3. The improvement defined in claim 1 wherein said guide rods are oriented horizontally and said tool block when free is returnable into a contacting position from said beginning piece mounting location on operation of a returning spring.

4. The improvement defined in claim 1 wherein said contacting elements are mounted on a mounting plate slidable perpendicular to said guide rods, have at least one bearing surface and are pivotable by at least one opposing bearing surface on said tool block in said mounting motion of said beginning piece mounting tool.

5. The improvement defined in claim 1 wherein said beginning piece mounting tool is part of a mounting machine with which said beginning pieces are cross cut and molded from a metal strip.

6. An apparatus for putting at least one metal beginning piece on a continuous slide fastener chain made by connecting a plurality of slide fasteners each with a beginning piece region for receiving said metal beginning piece and with the first slide fastener coupling members bounding said beginning piece region of said slide fastener comprising:

a tool block which is slidable on a plurality of guide rods oriented substantially in the feed direction of said slide fastener chain substantially in a climbing inclined plane and said tool block when free is returnable from a beginning piece mounting location into a contacting position by the force of gravity;

two contacting elements associated with both halves of said slide fastener chain mounted on said tool block which are pivotable about contacting element pivot axes substantially parallel to said guide rods, said tool block being moveable with said slide fastener chain on said guide rods from a receiving position to said beginning piece mounting location by said slide fastener chain when said first slide fastener coupling members contact said contacting elements;

two clamp jaws associated with said contacting elements mounted on said tool block which similarly pivot about clamp jaw pivot axes substantially parallel to said guide rods, said clamp jaws being closable by at least one control surface against said contacting elements with said halves of said slide fastener chain transported interposed during motion of said tool block with said slide fastener chain;

a control member for operation of said clamp jaws which has said control surface extending substantially in the longitudinal direction of said guide rods which engages at least one opposing control surface on said clamp jaws; and a beginning piece mounting tool by which said metal beginning pieces are mountable in said beginning piece mounting location in said beginning piece region on said transported stringer halves of said slide fastener chain by a beginning piece mounting tool moveable up and down and said contacting elements are forced away from said beginning piece mounting tool during a mounting motion perpendicular to said guide rods.

* * * * *